US005953943A

United States Patent [19]

DeMario, Jr.

[11] Patent Number: 5,953,943

[45] Date of Patent: Sep. 21, 1999

[54] SECURITY LOCK

[76] Inventor: Arthur DeMario, Jr., 12831 SW. 115th Ter., Miami, Fla. 33186

[21] Appl. No.: 08/914,113

[22] Filed: Aug. 19, 1997

[51] Int. Cl.[6] ..... E05B 15/16

[52] U.S. Cl. ..... 70/417; 70/420; 70/424

[58] Field of Search ..... 70/417–424

[56] References Cited

U.S. PATENT DOCUMENTS

| | | | |
|---|---|---|---|
| 1,228,445 | 6/1917 | Janes | 70/417 X |
| 1,422,497 | 7/1922 | Thompson | 70/417 |
| 1,422,515 | 7/1922 | Augenbraun | 70/417 |
| 1,432,326 | 10/1922 | Freysinger | 70/417 X |
| 1,484,830 | 2/1924 | Hurd | 70/417 |
| 1,662,487 | 3/1928 | Briggs | 70/417 |
| 4,338,806 | 7/1982 | Cox | 70/417 |
| 4,648,255 | 3/1987 | Gartner | 70/417 |
| 5,713,231 | 2/1998 | Shen | 70/417 X |

FOREIGN PATENT DOCUMENTS

| | | | |
|---|---|---|---|
| 2303927 | 10/1976 | France | 70/417 |
| 2415184 | 9/1979 | France | 70/417 |
| 327350 | 10/1920 | Germany | 70/417 |
| 442553 | 5/1924 | Germany | 70/417 |
| 2609647 | 9/1977 | Germany | 70/417 |
| 3844165 | 6/1990 | Germany | 70/417 |

*Primary Examiner*—Suzanne Dino Barrett
*Attorney, Agent, or Firm*—McHale & Slavin

[57] ABSTRACT

A high security lock employs a key plug rotatably mounted within a lock housing. Restraining means selectively prevents relative motion between the key plug and lock housing. The key plug is operatively linked to a latch operating bar. The latch operating bar controls the position of a securing latch. A bracing means prevents access to the latch operating bar.

2 Claims, 2 Drawing Sheets

SECURITY LOCK

FIELD OF THE INVENTION

This invention relates to high-security locks, and in particular to reinforcements that prevent unauthorized access to latch-moving linkages within the lock.

BACKGROUND OF THE INVENTION

One of the most common types of locks uses a key to place tumblers within a housing into preferred orientations. This type of lock is commonly referred to as a pin tumbler lock, wherein the tumblers must be oriented in order to operate.

Pin tumbler locks utilize an inner key plug disposed within a lock housing. Insertion of a key into the key plug elevates tumblers which lie in tubes cut into the lock housing and key plug. When the correct key is inserted into the key plug, the tumblers are directed, as a group, into an unlocked orientation. When in this unlocked orientation, the tumblers create a gap or shear line between the key plug and the lock housing. When this gap is present, the lock is unsecured and the key plug will rotate within the lock housing.

Early pin tumbler locks were susceptible to unauthorized entry via a surreptitious process known as "lock picking." Lock picking involves inserting a narrow rod into the keyway of the key plug and rotating the key plug until the tumblers bind against the inside walls of the tumbler tubes. Once bound against the walls of the tumbler tubes, the tumblers may be individually lifted by a key pick and held in place frictionally by their contact with the tube inner walls. Through trial and error, the tumblers are lifted to their preferred location, creating the rotation-allowing gap or shear line within the lock. This approach simulates the presence of a key and allows the lock to be opened.

Locks that are pick-resistant, have modified tumblers. Placing these modified tumblers into their correct positions required lifting and twisting. This lifting and twisting was accomplished by keys with angled cuts that engaged inclined bottom surfaces of the tumblers. These special keys created a shear gap that allowed key plug rotation within the lock housing.

Although these improved pin tumbler locks were pick resistant, they had other problems. For example, these designs were susceptible to methods of forced entry known as "drilling a lock." A drill could be used to cut through the front of a lock, forcing the drill bit against the tumblers or other vital elements within the lock, and destroying the key plug-securing elements of the lock. Once these vital elements were destroyed, the key plug would rotate within the lock housing. "Drilling a lock" eliminated the need for keys or lock picking tools.

Additional lock designs were created to guard against this "lock drilling" procedure. Hardened-steel inserts prevented a drill bit from destroying vital securing elements inside the lock. Unfortunately, these known reinforcements were irrelevant in the face of other forced entry methods. As described below, known reinforced locks were still vulnerable.

Pin tumbler locks typically include a tailpiece that links the key plug with a latch operating bar. The tailpiece extends from the key plug and rotates when the key plug rotates. When the tailpiece is rotated, it engages a contoured aperture disposed within the latch operating bar. When the correct key is inserted into the key plug, the key, key plug, and tailpiece rotate as a unit, from a first, key-insertion position to a second, locking position.

As the inserted key is turned, the tailpiece rotates to a second, locking position. During this rotation, the tailpiece engages ramped teeth in the latch operating bar aperture. By engaging the ramped teeth, the rotating tailpiece imparts lateral motion to the latch operating bar. A securing latch, commonly referred to as a "deadbolt", is attached to the latch bar and moves into a locking position because of this lateral motion.

Rotation of the key from this second, locking position back to the first position will return the tailpiece and key plug to the first position. However, because of the ramped shape of the teeth, this second-position-to-first-position rotation does not produce any tailpiece-tooth engagement. As a result, although the tailpiece and key plug move from the second position to the first position, the latch and latch operating bar remain extended in a locking position. In other words, the tailpiece "slips" within the aperture of the latch operating bar when the tailpiece moves from the second position back to the first position. It is only when the key plug and tailpiece are rotated from the second position, past the first position, and into a third position that the latch is moved from the extended or locked position into a recessed or unlocked position. This is because the tailpiece engages the inner teeth of the latch operating bar aperture when it moves from the second position through to the third position.

Since the tailpiece and latch operating bar are not rigidly linked, only certain motions of one will move the other. This "limited-slip" arrangement allows an individual to remove a key from this type of lock without placing the lock into an unsecured orientation. Unfortunately, this limited slippage also makes the lock vulnerable to forced entry.

Known pin tumbler locks are pick-resistant and even include features to prevent destruction of vital elements within the lock. These reinforcements are designed to prevent the key plug from rotating within the lock housing. This, in turn, prevents motion of the tailpiece and subsequent motion of the latch.

However, the limited slip that allows the tailpiece to move without disturbing the latch conversely allows the latch to move without engaging the tailpiece. Thus, it is possible to move the latch operating bar without moving the tailpiece. The latch operating bar and the attached securing latch may be translated or slid from an extended, door-securing position to a retracted, door-releasing position without binding against the locker key plug and tailpiece. A secured tailpiece, therefore, does not guarantee a secured latch.

While known lock designs prevent unwanted motion of key plugs and tailpieces, they do not prevent the latch operating bar from moving separately from the tailpiece. This is troublesome because although known locks include inserts to prevent drilling aimed at destroying cylinder securing elements of the lock, known locks do not stop attacks designed to move the latch directly without using the tailpiece.

Drilling through the relatively-soft metal of the key plug and lock housing will expose a pathway to the aperture in the latch operating bar. A screwdriver, or the drill bit used to create the tunnel itself, will imitate the tailpiece if placed within the latch operating bar aperture. When rotated, the inserted screwdriver or drill bit will provide the appropriate twisting motion needed to operate the latch. The latch may be slid, without a key, from its locked position to its unlocked position, allowing a previously-secured door to open. All of this motion is possible without disturbing the lock tumblers or other securing elements within the lock.

This "latch manipulating" method of forced entry completely circumvents known lock reinforcements. Known locks prevent unwanted motion of the key plug and tailpiece as a way preventing latch motion. Unfortunately, these designs are vulnerable to methods of forced entry that move the latch directly, without relying on tailpiece motion. Since the latch will move even if the tailpiece will not, after a path to the latch operating bar has been drilled, a simple twist of a screwdriver will move the latch and open the lock. However, a screwdriver is often not needed: if the rotating drill bit contacts the aperture teeth during drilling, the bit itself moves the latch operating bar and opens the lock.

Creating locks made entirely from drill-resistant materials is not practical. Locks are typically installed with mounting screws that pass through the lock housing. As a result, the lock housing includes threaded bores to accommodate the mounting screws. Since the threaded bores must be cut into the housing, making the lock from drill-resistant material would unduly hamper the bore-creating process.

Creating locks made entirely from drill-resistant materials is also not desirable: drill-resistant materials are often brittle by nature. Locks constructed from excessive amounts of drill-resistant material may trade one problem for another: brittle materials often shatter under direct impact. Locks of the prior art teachings made with excessive amounts of drill-resistant materials may be destroyed by blows from a hammer, for example. As such, no key or drilling is necessary.

Thus, what is needed in this art is a device which prevents unwanted access to the latch operating bar. Furthermore, the device should resist forced entry attempts that open the lock by moving the latch operating bar directly, without tailpiece motion.

SUMMARY OF THE INVENTION

This invention is an improved lock having reinforcements that fortify the rear of the lock, preventing penetration thereof and passage therethrough. The lock itself includes a lock housing with a key plug rotatably engaged within the lock housing. The key plug includes a keyway that extends between a front wall and a back wall. A restraining means selectively prevents rotation of the key plug within the lock housing, and a control means selectively positions a securing latch. A connection means links the control means to the key plug. The reinforcements include members that fortify the rear of the lock, preventing unauthorized access to, and manipulation of, the control means.

Accordingly, it is object of the present invention to create a reinforced lock that resists drill-based attempts at gaining access to the latch control means.

It is another object of the present invention to provide a reinforced lock which prevents penetration of the back wall of the lock.

It is yet a further object of the present invention to create a reinforced lock which contains removable fortification members.

It is also an object of the present invention to provide a reinforced lock that is not vulnerable to impact attacks.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
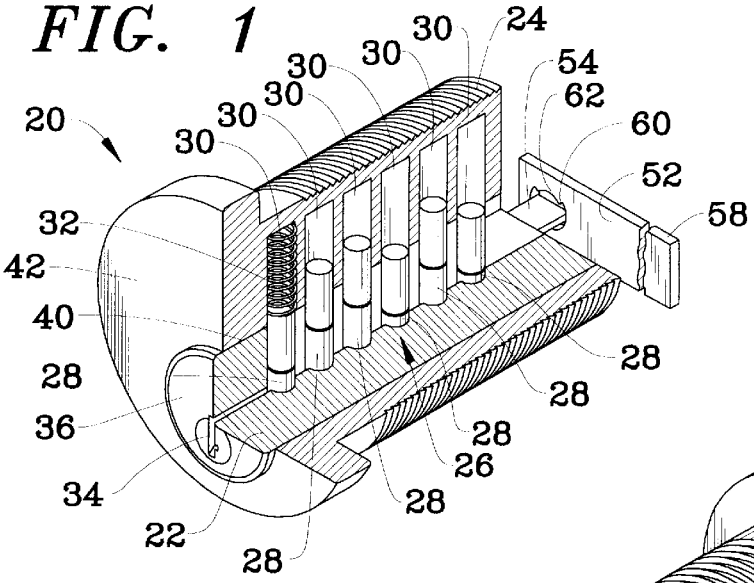
FIG. 1 is a front cut-away perspective view of the pin tumbler lock of the present invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Now with respect to FIG. 1, the reenforced lock 20 of the present invention is shown. The lock 20 includes a key plug 22 that is rotatably mounted within a substantially-cylindrical lock housing 24. A restraining means 26 selectively prevents rotation of the key plug 22 within the lock housing 24. The restraining means 26 includes tumblers 28 disposed within tumbler tubes 30. Biasing springs 32 may be included to urge the tumblers into a keyway 34 that extends between the front wall 36 and back wall 38 of the key plug 22. A key (not shown) inserted into the keyway 34 will move the tumblers 28 within the tumbler tubes 30. When the tumblers 28 are properly positioned, they clear a shear line 40 or gap that separates the key plug 22 from the lock housing 24. By clearing the shear line 40, the correctly positioned tumblers allow the key plug 22 to turn within the lock housing 24.

Figure 2:
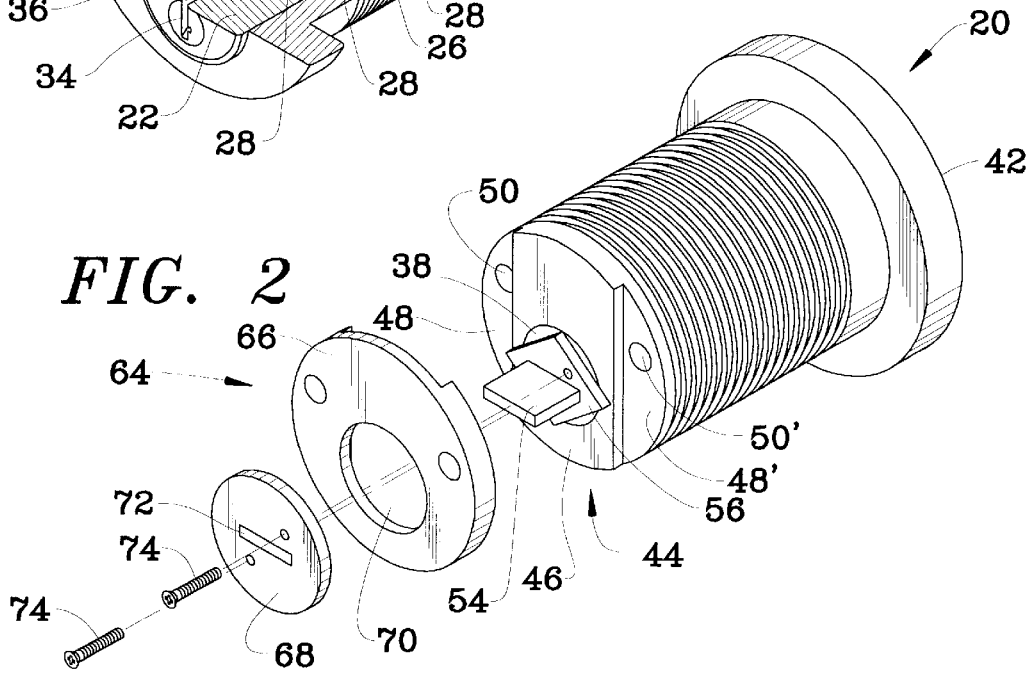
FIG. 2 is an exploded perspective view of the pin tumbler lock of the present invention.

Now, with reference to FIG. 2, a rear exploded view of the reinforced lock according to the present invention is shown. The housing 24 includes a front wall 42 that is spaced apart from a contoured back wall 44. The lock housing back wall 44 includes a raised center panel 46 that separates a pair of recessed notches 48, 48'. The center panel 46 is flush with the key plug back wall 38, and the recessed notches include threaded bores, 50, 50' to accept installation screws (not shown). The notches 48, 48' may alternatively be flush with the center panel 46.

Now referring to FIGS. 1 and 2, the reinforced lock includes a latch operating bar 52 linked to the key plug 22 by a tailpiece 54 that extends orthogonally from the key plug back wall 38. A tail piece retainer 56 secures the tail piece 54 to the key plug back wall 38. The latch operating bar 52 controls the position of an integral latch 58 or deadbolt and includes a tailpiece-receiving aperture 60. The tailpiece 54 has a rectangular cross-section sized to fit within the latch operating bar aperture 60.

The tailpiece 54 interacts with ramped teeth 62 located within the latch operating bar aperture 60. The tailpiece 54 rotates about the central axis 63 as the key plug 22 is rotated by a key (not shown) inserted into the keyway 34. Along certain portions of the rotational path of the tailpiece 54, the tailpiece engages the ramped teeth 62 within the tailpiece-aperture 60. When the tailpiece 54 engages the teeth 62, the latch operating bar 52 and latch 58 move laterally. Because of the shape of the aperture 60 and teeth 62, only some motion of the tailpiece 54 will engage the teeth 62 and move the latch 58. For example, as the key plug 22 and attached tailpiece 54 are rotated from a first or key-insertion/removal position, to a second position displaced 90 degrees therefrom, the tailpiece 54 engages the ramped teeth 62. This motion slides the latch operating bar 52 and latch 58 laterally into an extended position. As the key plug 22 is rotated back to the first position from the second position, the tailpiece 54 does not engage the ramped teeth 62. As a result, the latch operating bar 52 and latch 58 remain in place. In this manner, the key may be removed without disturbing the position of the latch 58. However, if the key plug 22 is rotated past the first position, towards a third position, the tailpiece 54 again engages the teeth 62 inside the latch operating bar aperture 60. As the tailpiece 54 rotates to the third position, which is displaced 180 degrees from the second position, the latch operating bar 52 translates laterally into a retracted position.

As described above, although the tailpiece 54 and latch operating bar 52 interact, it is possible to move the tailpiece 54 without disturbing the latch operating bar 52. Similarly, it is possible to move the latch operating bar 52 without engaging the tailpiece 54.

As a result, it is possible to move the latch 58 from its extended position to its retracted position even when the tailpiece 54 is locked in place. That is to say, simply securing the key plug 22 and tailpiece 54 does not secure the latch 58.

Figure 3:
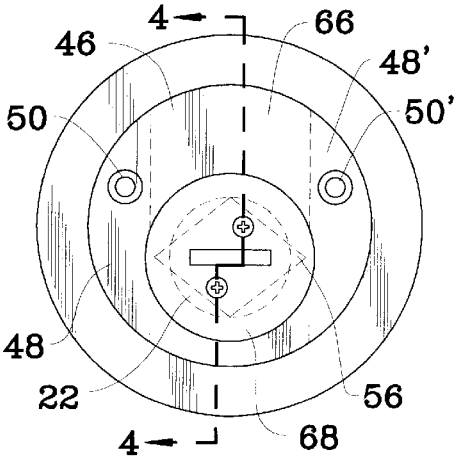
FIG. 3 is an end view of the lock reinforcement of the present invention.
Figure 4:
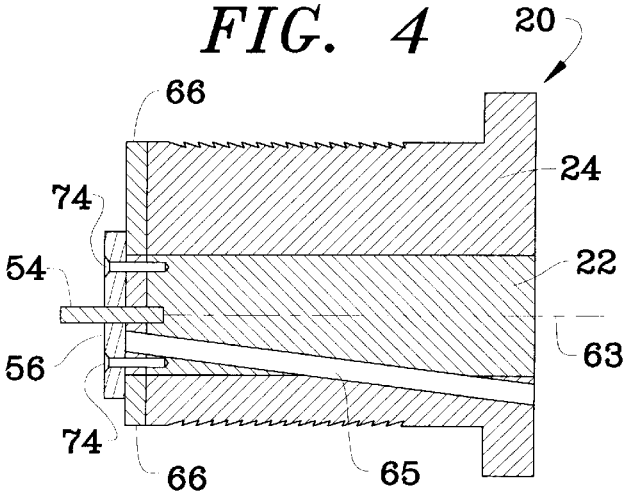
FIG. 4 is a sectional view of the lock reinforcement of the present invention, taken along line 4—4 in FIG. 3.

As shown in FIGS. 2,3, and 4, one embodiment of the present invention includes bracing means 64 to prevent the use of a drill to bore a path 65 through the lock 20 to gain access to the latch operating bar aperture 60.

The bracing means 64 includes a pair of hardened-steel blocking members 66, 68 that arrest the progress of a drill bit (not shown) aimed at the latch operating bar aperture 62. The first blocking member 66 is a plate shaped to follow the contours of the lock housing back wall 44. The first blocking member 66 includes a tailpiece opening 70 that is coplanar with the tailpiece retainer 56. The tailpiece opening 70 is sized to allow the tailpiece retainer 56 to move freely as the keyplug 22 and the tailpiece 54 rotate during operation of the lock 20. The second locking member 68 is a substantially-circular disc with an outer diameter that is larger than the diameter of the tailpiece opening 70. The second blocking member 68 includes a tailpiece slot 72 through which the tailpiece 58 extends. The second blocking member 68 is held in place by securing screws 74 that extend through the second blocking member, through the tailpiece retainer 56, and lodge into the keyplug 22. The second blocking member 68 rotates with the keyplug 22 and tailpiece 54. Because the second blocking member 68 overlaps the tailpiece opening 70, the second blocking member advantageously guards the latch operating bar aperture 60 regardless of the keyplug 22 orientation. Depending upon dimensional requirements of the lock to be reinforced, the second blocking member 68 may serve as a replacement for the tailpiece retainer 56, with the tailpiece opening 70 enlarged accordingly.

Figure 5:
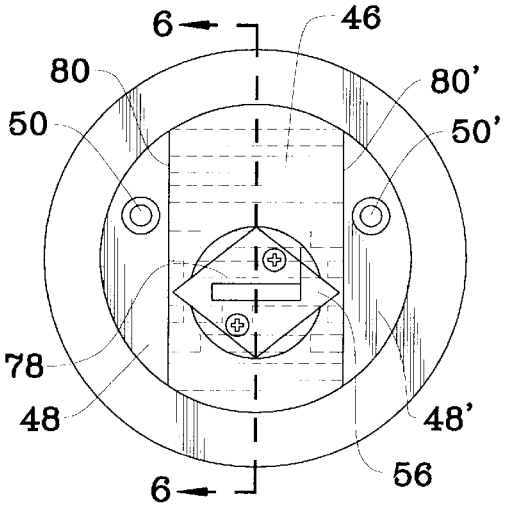
FIG. 5 is an end view of an alternate embodiment of the lock reinforcement of the present invention.
Figure 6:
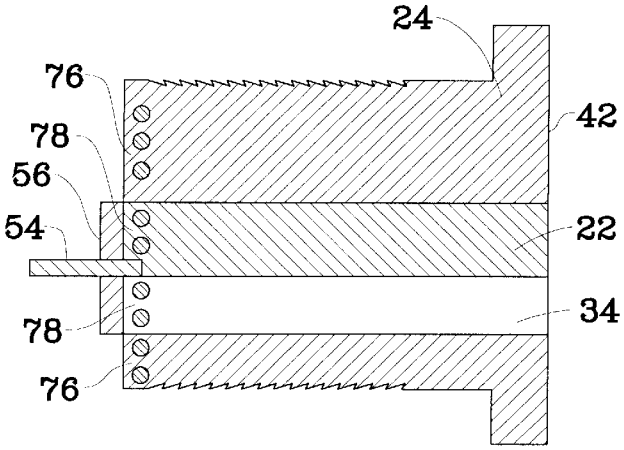
FIG. 6 is a sectional view of an alternate embodiment the lock reinforcement of the present invention, taken along line 6—6 in FIG. 5.

Now, with reference to FIGS. 5 and 6, the bracing means 64 may alternatively be two cooperating sets 76, 78 of hardened-steel rods disposed within the back of the lock 20. In this embodiment, a first set of rods 76 is arranged within the center panel 46 of the lock housing back wall 44. The first set of rods 76 extends orthogonally between side edges 80, 80' of the center panel 46. The first set of rods 76 is sized to allow free rotation of the keyplug 22 while denying access to the latch operating bar aperture 60. The second set of rods 78 compliments the first set of rods 76. The second set of rods 78 is disposed within the key plug back wall 38. The second set of rods 78 is sized and positioned to accommodate the securing screws 74 and the tailpiece 54. The second set of rods 78 is parallel to the first set of rods 76, when the keyway 34 is empty and the key plug 22 is locked in place.

Figure 7:
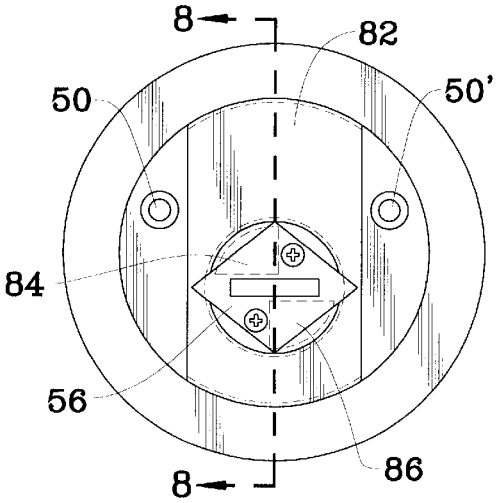
FIG. 7 is an end view of an alternate embodiment of the lock reinforcement of the present invention.
Figure 8:
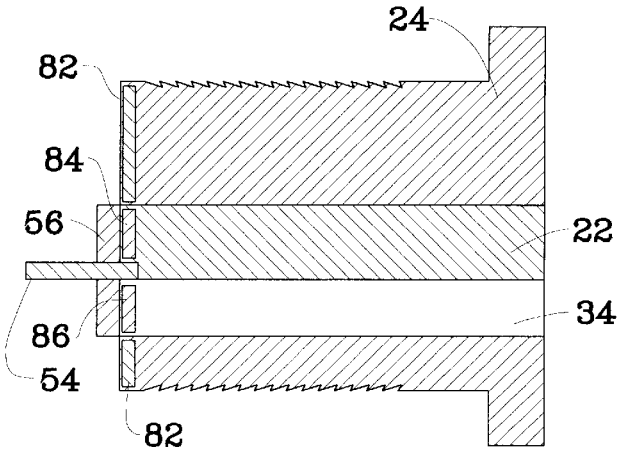
FIG. 8 a sectional view of an alternate embodiment the lock reinforcement of the present invention, taken along line 8—8 in FIG. 7.

As shown in FIGS. 7 and 8, the bracing means 64 may alternatively include a trio of hardened-steel plates 82,84,86 located inside the back of the lock 20. The first plate 82 is disposed within the center panel 46 of the lock housing back wall 44 and allows free rotation of the keyplug 22. The second and third plates 84,86 are disposed within the key plug back wall 38 and are positioned to accommodate the securing screws 74 and tailpiece 54. The second and third plates 84, 86 may be combined into a single plate that is perforated as needed to accept the securing screws 74 and the tailpiece 54.

Although the bracing means 64 has been described as including hardened steel members, other drill-resistant materials may be used as well.

What is claimed is:

1. An improved tumbler security lock having a lock housing including a front face and a rear face; a key plug rotatably engaged within said lock housing; said key plug having front wall, a rear wall, and a keyway; said keyway having a major axis that extends therebetween; locking means to selectively prevent rotation of said key plug relative to said lock housing; control means for selectively positioning a latch; and connection means to operatively link said control means with said key plug; said improvement comprising:

a first bracing means to reinforce said key plug rear wall, said first bracing means including at least one blocking member juxtaposed with said key plug rear wall, said first bracing means being constructed and arranged to prevent penetration of said key plug rear wall, said first bracing means being substantially congruent with said key plug rear wall, said first means being a plurality of hardened steel rods disposed within said key plug rear wall, said rods arranged in a plane parallel to said key rear wall; and a second bracing means to reinforce said lock housing rear face, said second bracing means including at least one blocking member juxtaposed with said housing rear face, said second bracing means being constructed and arranged to prevent penetration of said housing rear face, said second bracing means being substantially congruent with said housing rear face, said second bracing means being a plurality of hardened steel rods disposed within said lock housing, rear face said rods arranged in a plane parallel to said lock housing rear fact;

whereby said first and second bracing means cooperate to prevent access to and unauthorized manipulation of said control means, when said lock is disposed within a door.

2. An improved tumbler security lock having a lock housing including a front face and a rear face; a key plug rotatably engaged within said lock housing; said key plug having front wall, a rear wall, and a keyway; said keyway having a major axis that extends therebetween; locking means to selectively prevent rotation of said key plug relative to said lock housing; control means for selectively positioning a latch; and connection means to operatively link said control means with said key plug; said improvement comprising:

a first bracing means to reinforce said key plug rear wall, said first bracing means including at least one blocking member juxtaposed with said key plug rear wall, said first bracing means being constructed and arranged to prevent penetration of said key plug rear wall, said first bracing means being substantially congruent with said key plug rear wall, said first bracing means being a plurality of hardened steel rods disposed against said key plug rear wall, said rods arranged in a plane parallel to said key plug rear wall; and a second bracing means to reinforce said lock housing rear face said second bracing means including at least one blocking member juxtaposed with said housing rear face, said second bracing means being constructed and arranged to prevent penetration of said housing rear face, said second bracing means being substantially congruent with said key plug rear wall, said second bracing means being a plurality of hardened steel rods disposed against said lock housing rear face, said rods arranged in a plane parallel to said lock housing rear face;

whereby said first and second bracing means cooperate to prevent access to and unauthorized manipulation of said control means, when said lock is disposed within a door.

* * * * *